US007612977B2

(12) United States Patent
Protze

(10) Patent No.: US 7,612,977 B2
(45) Date of Patent: Nov. 3, 2009

(54) ELECTRICAL SUPPLY CIRCUIT, SWITCH ACTIVATING APPARATUS AND METHOD FOR OPERATING A SWITCH ACTIVATING APPARATUS

(75) Inventor: Carsten Protze, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 212 days.

(21) Appl. No.: 11/908,804

(22) PCT Filed: Mar. 6, 2006

(86) PCT No.: PCT/EP2006/060474

§ 371 (c)(1),
(2), (4) Date: Sep. 17, 2007

(87) PCT Pub. No.: WO2006/097412

PCT Pub. Date: Sep. 21, 2006

(65) Prior Publication Data

US 2008/0191821 A1 Aug. 14, 2008

(30) Foreign Application Priority Data

Mar. 16, 2005 (DE) ..... 10 2005 013 196

(51) Int. Cl.
*H01H 47/00* (2006.01)
*H01H 47/32* (2006.01)

(52) U.S. Cl. ..... 361/139; 361/155; 361/156; 361/210; 335/229

(58) Field of Classification Search ..... 361/139, 361/152–156, 160, 206, 210; 335/229–234; 123/90.11
See application file for complete search history.

(56) References Cited

U.S. PATENT DOCUMENTS

| | | | | |
|---|---|---|---|---|
| 3,514,674 | A * | 5/1970 | Ito et al. | 361/194 |
| 6,046,423 | A * | 4/2000 | Kishida et al. | 218/154 |
| 6,295,191 | B1 * | 9/2001 | Kishida et al. | 361/139 |
| 6,353,376 | B1 * | 3/2002 | Takeuchi et al. | 335/147 |
| 6,611,413 | B2 * | 8/2003 | Takeuchi et al. | 361/139 |
| 6,882,515 | B2 * | 4/2005 | Takeuchi et al. | 361/160 |
| 2002/0044403 | A1 | 4/2002 | Takeuchi et al. | |
| 2004/0201943 | A1 | 10/2004 | Takeuchi et al. | |

(Continued)

FOREIGN PATENT DOCUMENTS

DE 101 28 616 A1 5/2002

(Continued)

*Primary Examiner*—Ramon M Barrera
(74) *Attorney, Agent, or Firm*—Laurence A. Greenberg; Werner H. Stemer; Ralph E. Locher

(57) ABSTRACT

An electric supply circuit is provided for a switch actuating device containing an actuator, an electromagnetic drive for displacing the actuator from a first switching position to a second switching position, and a mechanical return device for returning the actuator from the second switching position to the first switching position. A magnetic fixing unit is provided for fixing the actuator in the second switching position and an electromagnetic releasing device is provided for releasing the fixation. The electric supply device contains a first capacitor electrically connectable to the electromagnetic drive and used for supplying electric power thereto and a second capacitor that is electrically connectable to the releasing device and supplies electric power thereto for releasing the fixation. An electric switchable connection is provided between the first and second capacitors.

12 Claims, 1 Drawing Sheet

U.S. PATENT DOCUMENTS

2006/0139135 A1 6/2006 Kampf et al.

FOREIGN PATENT DOCUMENTS

DE 103 09 697 B3 9/2004
DE 10 2004 005 770 A1 10/2004
EP 0 867 903 A2 9/1998
EP 0 867 903 A3 9/1998
EP 0 867 903 B1 9/1998
EP 0 977 229 A2 2/2000
WO 03/056677 A1 7/2003

* cited by examiner

ELECTRICAL SUPPLY CIRCUIT, SWITCH ACTIVATING APPARATUS AND METHOD FOR OPERATING A SWITCH ACTIVATING APPARATUS

BACKGROUND OF THE INVENTION

1. Field of the Invention

The invention relates to an electrical supply circuit for a switch activating apparatus for moving an actuating element from a first switching position into a second switching position, a switch activating apparatus and a method for operating a switch activating apparatus.

EP 0 867 903 B1 and DE 103 09 679 B3 have disclosed switch activating apparatuses having an actuating element which can be moved to and fro in relation to a frame between a switch-off position and a switch-on position, in which apparatuses the actuating element is magnetically fixed in the switch-on position and mechanically fixed in the switch-off position.

In order to move the actuating element from the switch-off position into the switch-on position, a magnetic field produced by a coil is used. The electrical energy required for producing the magnetic field is stored in a closing capacitor.

In order to move the actuating element from the switch-on position into the switch-off position, essentially the resetting force of resetting springs is used. The resetting springs are tensioned during the movement of the actuating element from the switch-off position into the switch-on position, with the result that the energy required for moving the actuating element from the switch-on position into the switch-off position is stored substantially as mechanical energy in the springs. Only for releasing the magnetic fixing is it necessary to supply current to a release coil, which produces a magnetic field counteracting the fixing magnetic field. As soon as the fixing has been canceled and the switching operation of the resetting springs is driven, it is no longer necessary for there to be a current flow through the release coil. The electrical energy for the release coil is stored in an isolating capacitor, whose capacitance is markedly lower than that of the closing capacitor.

If the actuating element is now first guided from the switch-on position into the switch-off position and thereupon into the switch-on position again, the isolating capacitor first and thereupon also the closing capacitor are discharged. If thereupon the actuating element is again moved into the switch-off position, first the isolating capacitor needs to be recharged by means of an external charging unit, which may require a considerable amount of time. A rapid OCO (Open-Close-Open or switch-off-switch-on-switch-off) switching sequence can therefore not be ensured.

Other switch activating apparatuses known in the prior art have in particular isolating capacitors, whose capacitance can take up a multiple of the charge required for moving the actuating element from the switch-on position into the switch-off position. Although an OCO switching sequence is therefore possible without any intermediate charging by means of an external charging unit, against this other disadvantages need to be accepted with these control circuits. Since the capacitor is not completely discharged when the release coil is switched, the circuit comprising the capacitor and the coil needs to be interrupted at a suitable time, which makes it necessary to connect an inductive current. Furthermore, the voltage of the capacitor needs to be monitored in order to decide whether the remaining charge is still sufficient for operating the release coil.

Finally, it is also known from the prior art in the case of switch activating apparatuses as have been described at the outset to provide two isolating capacitors for the purpose of moving the actuating element from the switch-on position into the switch-off position, one of the two isolating capacitors being completely discharged in the case of each isolation in an OCO switching sequence.

SUMMARY OF THE INVENTION

The invention is based on the object of making available an improved electrical supply circuit for a switch activating apparatus. In addition, an object of the invention is to make available an improved switch activating apparatus and a method for operating such a switch activating apparatus.

The first object is achieved by an electrical supply circuit as claimed in claim 1, the second object by a switch activating apparatus as claimed in claim 8 and a method as claimed in claim 11. The dependent claims contain advantageous developments of the invention.

An electrical supply circuit according to the invention for a switch activating apparatus having an actuating element, an electromagnetic drive for bringing the actuating element from a first switching position, for example the switch-off position of a high-voltage switch, for example, into a second switching position, for example the switch-on switching position of the high-voltage switch mentioned by way of example, a mechanical resetting apparatus for bringing the actuating element from the second switching position back into the first switching position, a magnetic fixing unit for fixing the actuating element in the second switching position and an electromagnetic release apparatus for releasing the fixing comprises:

- a first capacitor, which can be electrically connected to the electromagnetic drive, for storing the electrical energy for the electromagnetic drive, and
- a second capacitor, which can be electrically connected to the release apparatus, for storing the electrical energy required by the release apparatus for releasing the fixing. In the supply circuit according to the invention, a switchable electrical connection is provided between the first capacitor and the second capacitor.

The electrical supply circuit according to the invention makes it possible to implement an OCO switching sequence in a switch activating apparatus with merely the first capacitor as a closing capacitor and the second capacitor as a single isolating capacitor, without charging of the isolating capacitor by means of an external charging unit needing to take place between the two switch-off operations and without the isolating capacitor needing to store sufficient charge for a second switch-off operation. In the supply circuit according to the invention, the isolating capacitor can be recharged after the first isolating operation of an OCO switching sequence via the switchable electrical connection by the first capacitor.

Recharging of the second capacitor from the first capacitor can take place immediately after the second capacitor has been discharged for the first time in an OCO switching sequence, in particular prior to or possibly also during the energization of the drive coil by means of the first capacitor. The release coil is therefore operational again within a very short period of time and an OCO switching operation can be implemented in a rapid sequence without the need for intermediate charging of the second capacitor by means of an external charging unit.

In order to implement the OCO switching sequence it is sufficient for the second capacitor, i.e. the isolating capacitor, to be equipped with a capacitance which is precisely so great that it is precisely sufficient for a single release operation, and for the first capacitor, i.e. the closing capacitor, to be equipped with a capacitance which is sufficient precisely for carrying out a closing operation, i.e. for bringing the actuating element from the first switching position into the second switching position, and for recharging the isolating capacitor once.

In order to charge the capacitors prior to an OCO switching sequence, the electrical supply circuit can have a charging unit, which is switchably connected to the first capacitor and the second capacitor.

In an advantageous configuration of the electrical supply circuit, a switch, by means of which the first capacitor can be connected to the charging unit, and a switch, by means of which the first capacitor can be connected to the drive, are provided, which switches are coupled to one another in such a way that the first capacitor is not simultaneously electrically connected to the charging unit and the drive. This configuration is used for protecting the switching apparatus and in particular ensures that the charging unit is not to be connected to the drive.

In a further advantageous configuration of the electrical supply circuit, a switch, by means of which the second capacitor can be connected to the first capacitor and/or the charging unit, and a switch, by means of which the second capacitor can be connected to the release apparatus, are provided, which switches are coupled to one another in such a way that the second capacitor cannot be electrically connected simultaneously to the first capacitor or the charging unit, on the one hand, and the release apparatus, on the other hand. This configuration is used for protecting the switching apparatus, in particular the release apparatus, by it ensuring that the charging unit and the first capacitor are not to be connected to the release apparatus.

In an expedient embodiment, the electrical supply circuit has a current limiting resistor, which is connected between the first capacitor and the second capacitor. Said current limiting resistor is advantageously configured in accordance with the maximum switch-on power of the contacts of the switch and the permissible temporal delay with which the second capacitor follows the voltage state of the first capacitor.

In order to prevent charge from being fed back from the second capacitor to the first capacitor, it is advantageous if the electrical supply circuit has a rectifier, which is connected between the first capacitor and the second capacitor, or a diode. Alternatively, a switching element can also be used which keeps the second capacitor isolated from the electromagnetic drive whilst the actuating element is brought from the first switching position into the second switching position.

A switch activating apparatus according to the invention which may be in particular in the form of an activating apparatus for a high-voltage switch comprises:

an actuating element, an electromagnetic drive for providing a switching force bringing the actuating element from a first switching position, for example the switch-off position of a high-voltage switch, for example, into a second switching position, for example the switch-on position of said high-voltage switch, a mechanical resetting apparatus for providing a resetting force bringing the actuating element from the second switching position into the first switching position, a magnetic fixing unit for providing a fixing force fixing the actuating element in the second switching position, and an electromagnetic release apparatus for providing a release force overcoming the fixing force.

In addition, the switching apparatus according to the invention comprises an electrical supply circuit according to the invention.

The switch activating apparatus according to the invention makes it possible to implement an OCO switching sequence given the presence of only one first capacitor as the closing capacitor and one second capacitor as the single isolating capacitor in the electrical supply circuit without charging of the isolating capacitor by means of an external charging unit needing to take place between the two switch-off operations and without the isolating capacitor needing to store sufficient charge for a second switch-off operation. Further details in this regard have already been explained with reference to the electrical supply circuit according to the invention.

In an advantageous development of the switch activating apparatus, the release apparatus comprises a release coil, which is switchably connected to the second capacitor, for producing a magnetic field applying the release force. In addition, the capacitance of the second capacitor and the inductance of the release coil are matched to one another in such a way that the second capacitor together with the release coil forms an electrical resonant circuit, in which the current flowing in the first current half-wave is sufficient for producing the magnetic field applying the release force. In this way, the first current half-wave can be used in order to output the charge stored in the second capacitor completely to the release coil. Once the release coil has been activated, no unused charge therefore remains in the capacitor. In other words, the electrical energy stored in the second capacitor can be utilized completely, and the second capacitor only needs to have the minimum capacitance required for operating the release coil. In addition, virtually currentless interruption of the electrical resonant circuit once the magnetic field applying the release force has been produced is possible, with the result that it is not necessary to connect an inductive current.

In a further advantageous development of the switch activating apparatus, the drive comprises a drive coil, which is switchably connected to the first capacitor, for producing a magnetic field applying the switching force. In addition, the capacitance of the first capacitor and the inductance of the drive coil are matched to one another in such a way that the first capacitor together with the drive coil forms an electrical resonant circuit, in which the current flowing in the first current half-wave is sufficient for producing the magnetic field applying the switching force. In this way, the first current half-wave can be used for the purpose of outputting the charge stored in the first capacitor completely to the drive coil. Once the drive coil has been activated, no unused charge therefore remains in the first capacitor. In other words, the electrical energy stored in the first capacitor can be utilized completely, and the first capacitor only needs to have the minimum capacitance required for operating the drive coil and for recharging the second capacitor once. In addition, virtually currentless interruption of the electrical resonant circuit once the magnetic field applying the switching force has been produced is possible, with the result that it is not necessary to connect an inductive current.

In the method according to the invention for operating a switch activating apparatus according to the invention, the second capacitor is recharged from the first capacitor once a release operation has been carried out.

The method according to the invention makes it possible to implement an OCO switching sequence in a switch which has an electrical supply circuit with only one isolating capacitor, which also has only the capacitance for carrying out a single isolating operation. During the first switch-off operation of the OCO switching sequence, the second capacitor (isolating capacitor) can be completely discharged since it can be recharged by the first capacitor (closing capacitor) prior to the switch-on operation or possibly also during the switch-on operation. During the second switch-off operation of the OCO switching sequence, the second capacitor is therefore available again in the fully charged state.

If the second capacitor and the release coil of the release apparatus and/or the first capacitor and the drive coil of the drive form a resonant circuit in which the capacitance of the capacitor and the inductance of the coil are matched suitably to one another and the interruption of the electrical connection between the coil and the capacitor takes place after the first half-wave of the respective resonant circuit, complete emptying of the corresponding capacitor and currentless interruption of the electrical connection between the respective coil and the respective capacitor are possible with the method according to the invention.

An exemplary embodiment of the invention will be explained in more detail below with reference to the attached schematic drawings.

DESCRIPTION OF THE INVENTION

In the text which follows a switch activating apparatus for a high-voltage switch as an exemplary embodiment of the switch activating apparatus according to the invention will be described with reference to FIG. 1, and the associated electrical supply circuit as an exemplary embodiment of an electrical supply circuit according to the invention will be described with reference to FIG. 2.

The switch activating apparatus comprises a stationary ferromagnetic stator 28 and an actuating element 12, which is capable of moving to and fro between a first switching position and a second switching position in a cutout in said stator and is in the form of a ferromagnetic armature. This actuating element 12 has an actuating rod 12*a*, by means of which the high-voltage switch can be opened and closed. In FIG. 1, the actuating element 12 is in the first switching position, which in the exemplary embodiment selected represents the switch-on position of the high-voltage switch, i.e. that switching position in which the high-voltage switch actuated via the actuating rod 12*a* is closed.

Figure 1:
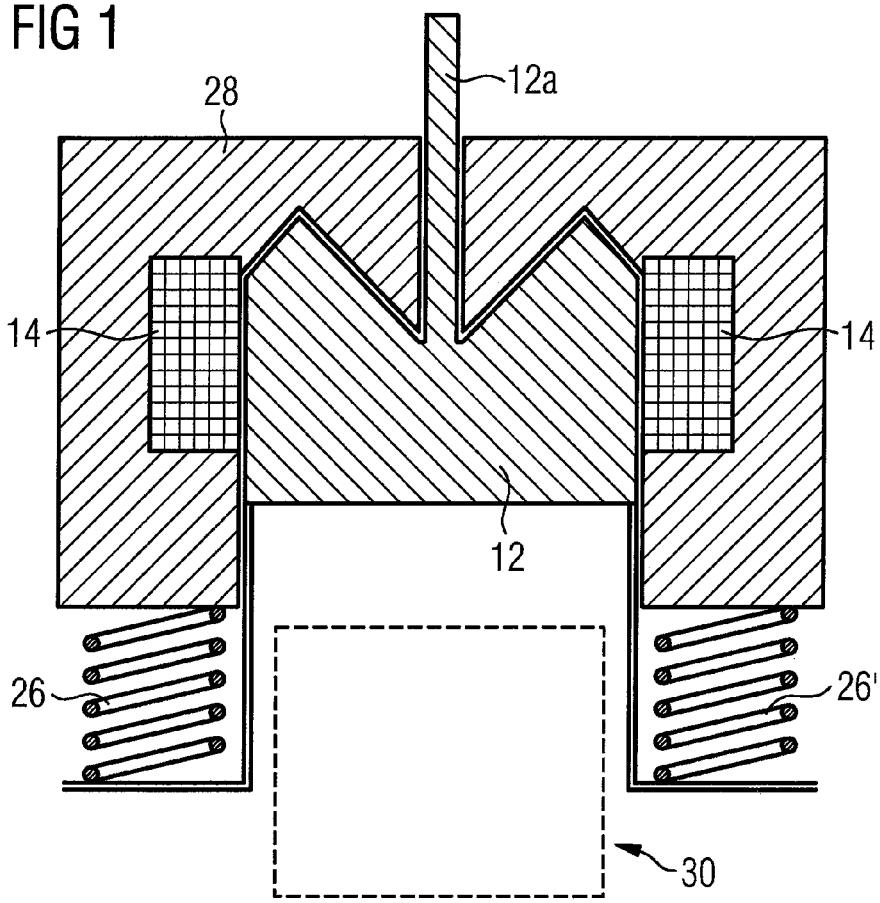
FIG. 1 shows a schematic sectional view of a switch activating apparatus having an actuating element located in the switch-on position.

The actuating element 12 is fixed in the switch-on position by means of a fixing device 30, which is only indicated schematically in FIG. 1. The fixing device 30 in the present exemplary embodiment contains a permanent magnet, which holds the actuating element 12 in the switch-on position counter to the action of resetting springs 26 and 26'. The resetting springs 26, 26' form a resetting apparatus for moving the actuating element 12 from the switch-on position into a second switching position which, in this present exemplary embodiment, is the switch-off position of the high-voltage switch, i.e. that position in which the high-voltage switch actuated via the actuating rod 12*a* is open.

The fixing device 30 furthermore contains a magnetic release coil 18, by means of which the fixing of the actuating element 12 can be released. For this purpose, the magnetic release coil 18 temporarily produces a field opposing the field of the permanently magnetic holding magnet. Owing to the temporary lack of holding force, the actuating element 12 thereupon moves into the switch-off position (at the bottom in FIG. 1) owing to the action of the resetting springs 26 and 26'. From this position, the actuating element 12 can then again be moved into the switch-on position counter to the action of the resetting springs 26, 26' by means of a magnetic drive coil 14.

Switch activating apparatuses with suitable fixing devices are described, for example, in the documents already mentioned at the outset, EP 0 867 903 B1 and DE 103 09 679 B3. Reference is therefore made to these documents with regard to suitable configurations of the fixing device 30.

Figure 2:
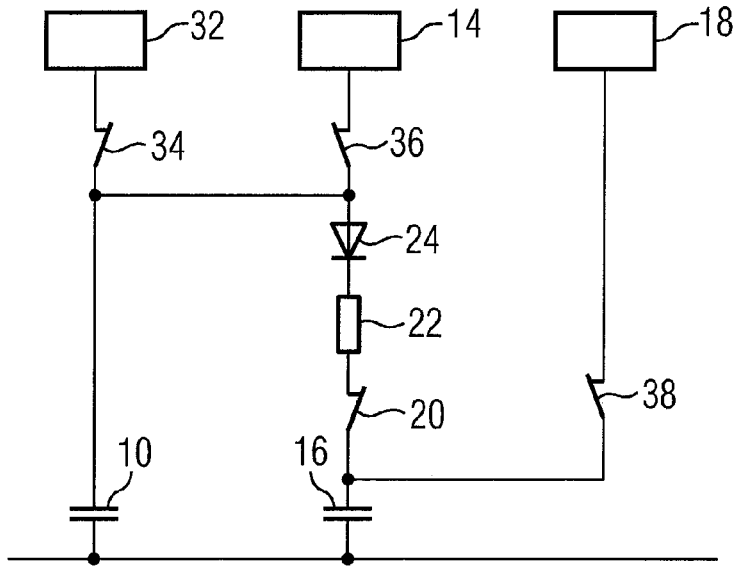
FIG. 2 shows the circuit diagram of an exemplary embodiment of an electrical supply circuit according to the invention.

The electrical supply circuit illustrated in FIG. 2 comprises a magnetic drive coil 14, a magnetic release coil 18, a first capacitor 10, which can be connected to the drive coil 14 for the purpose of energizing it, and a second capacitor 16, which can be connected to the release coil 18 for the purpose of energizing it. The capacitance of the second capacitor 16 is selected to be precisely great enough that it is precisely sufficient for releasing the fixing of the actuating element 12 once, and the capacitance of the first capacitor 10 is precisely great enough for it to be precisely sufficient for moving the actuating element 12 once from the switch-off position into the switch-on position counter to the resetting force of the resetting springs 26, 26' and for recharging the second capacitor 16. Since, when the actuating element 12 is moved from the switch-off position into the switch-on position, at the same time energy needs to be applied for tensioning the resetting springs 26, 26', the capacitance of the first capacitor 10 exceeds that of the second capacitor by a plurality, in particular by a multiple.

Furthermore, the supply circuit comprises a charging unit 32, which can be connected both to the first capacitor 10 and to the second capacitor 16, and a current limiting resistor 22 and a rectifier diode 24, which are connected between the first capacitor 10 and the second capacitor 16.

A recharging relay 20, a relay 34 for connecting the charging unit 32, a drive coil switching relay 36 and a release coil switching relay 38 are provided as switches. The recharging relay 20 is connected between the second capacitor 16 and the first capacitor 10, the relay 34 for connecting the charging unit 32 is connected between the charging unit 32, on the one hand, and the first capacitor 10 and the second capacitor 16, on the other hand, the drive coil relay 36 is connected between the first capacitor 10 and the drive coil 14, and the release coil relay 38 is connected between the second capacitor 16 and the release coil 18.

The first capacitor 10 can be connected to the drive coil 14 via the drive coil switching relay 36 for the purpose of energizing the drive coil 14, and the second capacitor 16 can be connected to the release coil 18 via the release coil switching relay 38 for the purpose of energizing the release coil 18. In addition, the second capacitor 16 for recharging via the recharging relay 20, the current limiting resistor 22 and the rectifier diode 24 need to be connected to the first capacitor 10. The first capacitor 10 and the second capacitor 16 can also each be connected to the charging unit 32 via the relay 34 for charging purposes. In the case of the second capacitor 16, the recharging relay 20 also needs to be connected via the charging unit 32 for charging purposes.

The drive coil switching relay 36 and the relay 34 for connecting the charging unit 32 are coupled to one another in such a way that they cannot be closed at the same time. As a result, a direct current flow from the charging unit 32 into the drive coil 14 should be avoided. Likewise, the recharging relay 20 and the release coil switching relay 38 are coupled to one another in such a way that they cannot be closed at the same time. As a result, a direct current flow from the charging unit 32 or the first capacitor 10 into the release coil 18 should be avoided.

The control circuit is configured so as to implement a so-called OCO (Open-Close-Open or switch-off-switch-on-switch-off) switching sequence. For this purpose, in the first step of such a switching sequence the first capacitor 10 and the second capacitor 16 are charged by the charging unit 32 by means of the relay 34 and the recharging relay 20 being closed.

In a second step, the relay 34 is opened, and the release coil switching relay 38 is closed. Thereupon, the charge stored in the second capacitor 16 flows away into the magnetic release coil 18, which results in a magnetic field releasing the fixing of the actuating element 12 located in the switch-on position. Releasing results in a displacement of the actuating element 12 from the switch-on position into the switch-off position owing to the mechanical energy stored in the resetting springs 26 and 26'.

When the release coil switching relay 38 is closed, the second capacitor 16 and the release coil 18 form an electrical resonant circuit, the charge flowing away out of the second capacitor 16 into the release coil 18 whilst utilizing the first current half-wave of the resonant circuit. The capacitor charge can thus be utilized completely, with the result that virtually no residual charge remains in the second capacitor 16 after the switching operation. A virtually currentless interruption of the electrical resonant circuit is therefore possible by means of the release coil switching relay 38 being opened after the switching operation.

In the third step, the release coil switching relay 38 is opened again and the recharging relay 20 is closed, whereupon the second capacitor 16 is recharged completely by the first capacitor 10. The second capacitor 16 is therefore recharged completely prior to the switch-on operation, with the result that a further switch-off operation can follow the switch-on operation immediately by the release coil 18 being operated by means of the second capacitor 16. Owing to the capacitances selected for the two capacitors, there is still sufficient charge remaining for implementing a switch-on operation in the first capacitor 10 once the second capacitor 16 has been recharged.

With regard to the recharging relay 20, the current limiting resistor 22 is configured in accordance with the maximum switch-on power of the contact of the relay 20 and of the permissible time delay with which the second capacitor 16 follows the voltage state of the first capacitor 10. Electrical energy is prevented from being fed back from the second capacitor 16 into the first capacitor 10 by the rectifier diode 24.

In the fourth step, the drive coil switching relay 36 is closed. As a result, the magnetic drive coil 14 is supplied with charge from the first capacitor 10 in such a way that the actuating element 12 is moved into the switch-on position counter to the action of the resetting springs 26 and 26'.

When the drive coil switching relay 36 is closed, the first capacitor 10 and the drive coil 14 form an electrical resonant circuit, the charge flowing away from the first capacitor 10 whilst utilizing the first current half-wave of the resonant circuit. In this way, the capacitor charge can be utilized completely, with the result that virtually no residual charge remains in the first capacitor 10 after the switching operation. A virtually currentless interruption of the electrical resonant circuit is therefore possible by means of the drive coil switching relay 36 being opened after the switching operation.

Once the switch-on operation is complete, a switch-off operation can take place immediately owing to the previously recharged second capacitor 16, as has already been described in step number two.

LIST OF REFERENCE SYMBOLS

10 Capacitor
12 Actuating element
12*a* Actuating rod
14 Magnetic drive coil
16 Capacitor
18 Magnetic release coil
20 Recharging relay
22 Current limiting resistor
24 Rectifier diode
26 First resetting spring
26' Second resetting spring
28 Stator
30 Fixing device
32 Charging unit
34 Relay for connecting the charging unit
36 Drive coil switching relay
38 Release coil switching relay

The invention claimed is:

1. An electrical supply circuit for a switch activating apparatus containing an actuating element, an electromagnetic drive for bringing the actuating element from a first switching position into a second switching position, a mechanical resetting apparatus for bringing the actuating element from the second switching position back into the first switching position, a magnetic fixing unit for fixing the actuating element in the second switching position, and an electromagnetic release apparatus for releasing the fixing, the electric supply circuit comprising:

a first capacitor electrically connected to the electromagnetic drive for storing electrical energy for the electromagnetic drive;

a second capacitor electrically connected to the electromagnetic release apparatus for storing electrical energy required by the electromagnetic release apparatus for releasing the fixing; and a switchable electrical connection connected between said first capacitor and said second capacitor.

2. The electrical supply circuit according to claim 1, further comprising a charging unit switchably connected to said first capacitor and said second capacitor.

3. The electrical supply circuit according to claim 2, further comprising:

a first switch connecting said first capacitor to said charging unit; and a second switch connecting said first capacitor to the electromagnetic drive, said first and second switches are coupled to one another such that said first capacitor is not simultaneously electrically connected to said charging unit and the electromagnetic drive.

4. The electrical supply circuit according to claim 2, wherein said switchable electrical connection includes:

a first switch connecting said second capacitor to at least one of said first capacitor and said charging unit; and a second switch connecting said second capacitor to the electromagnetic release apparatus, said first and second switches are coupled to one another such that said second capacitor cannot be electrically connected simultaneously to said first capacitor or said charging unit, on the one hand, and the electromagnetic release apparatus, on the other hand.

5. The electrical supply circuit according to claim 1, further comprising a current limiting resistor connected between said first capacitor and said second capacitor.

6. The electrical supply circuit according to claim 1, further comprising a rectifier connected between said first capacitor and said second capacitor.

7. The electrical supply circuit according to claim 1, wherein said second capacitor has a capacitance which is precisely so great that it is precisely sufficient for a single release operation, and said first capacitor has a capacitance which is sufficient precisely for bringing the actuating element from the first switching position into the second switching position and for recharging said second capacitor once.

8. A switch activating apparatus, comprising:

an actuating element;

an electromagnetic drive providing a switching force bringing said actuating element from a first switching position into a second switching position;

a mechanical resetting apparatus providing a resetting force bringing said actuating element from the second switching position into the first switching position;

a magnetic fixing unit providing a fixing force fixing said actuating element in the second switching position;

an electromagnetic release apparatus providing a release force overcoming the fixing force; and an electrical supply circuit containing a first capacitor electrically connected to said electromagnetic drive for storing electrical energy for said electromagnetic drive, a second capacitor electrically connected to said electromagnetic release apparatus for storing electrical energy required by said electromagnetic release apparatus for releasing the fixing, and a switchable electrical connection disposed between said first capacitor and said second capacitor.

9. The switch activating apparatus according to claim 8, wherein said electromagnetic release apparatus has a release coil switchably connected to said second capacitor for producing a magnetic field applying the release force, a capacitance of said second capacitor and an inductance of said release coil are matched to one another such that said second capacitor together with said release coil forms an electrical resonant circuit, in which current flowing in a first current half-wave is sufficient for producing the magnetic field applying the release force.

10. The switch activating apparatus according to claim 8, wherein said electromagnetic drive includes a drive coil switchably connected to said first capacitor for producing a magnetic field applying the switching force, and a capacitance of said first capacitor and an inductance of said drive coil are matched to one another such that said first capacitor together with said drive coil forms an electrical resonant circuit, in which a current flowing in a first current half-wave is sufficient for producing the magnetic field applying the switching force.

11. A method for operating a switch activating apparatus containing an actuating element, an electromagnetic drive providing a switching force bringing the actuating element from a first switching position into a second switching position, a mechanical resetting apparatus providing a resetting force bringing the actuating element from the second switching position into the first switching position, a magnetic fixing unit providing a fixing force fixing the actuating element in the second switching position, an electromagnetic release apparatus providing a release force overcoming the fixing force, and an electrical supply circuit containing a first capacitor electrically connected to the electromagnetic drive for storing electrical energy for the electromagnetic drive, a second capacitor electrically connected to the electromagnetic release apparatus for storing electrical energy required by the electromagnetic release apparatus for releasing the fixing, and a switchable electrical connection connected between said first capacitor and said second capacitor, which comprises the step of:

recharging the second capacitor from the first capacitor once a release operation has been carried out.

12. A method for operating a switch activating apparatus containing an actuating element, an electromagnetic drive having a coil providing a switching force bringing the actuating element from a first switching position into a second switching position, a mechanical resetting apparatus providing a resetting force bringing the actuating element from the second switching position into the first switching position, a magnetic fixing unit providing a fixing force fixing the actuating element in the second switching position, an electromagnetic release apparatus providing a release force overcoming the fixing force, and an electrical supply circuit containing a first capacitor electrically connected to the electromagnetic drive for storing electrical energy for the electromagnetic drive, a second capacitor electrically connected to the electromagnetic release apparatus for storing electrical energy required by the electromagnetic release apparatus for releasing the fixing, and a switchable electrical connection connected between said first capacitor and said second capacitor, the electromagnetic release apparatus having a release coil switchably connected to the second capacitor for producing the magnetic field applying the release force, and a capacitance of the second capacitor and an inductance of the release coil are matched to one another such that the second capacitor together with the release coil forms an electrical resonant circuit, in which current flowing in a first current half-wave is sufficient for producing the magnetic field applying the release force, which comprises the step of:

performing an interruption of an electrical connection between the release coil and the second capacitor or between the drive coil and the first capacitor after a first half-wave of the resonant circuit.

* * * * *